US009617937B2

(12) United States Patent
Baroni et al.

(10) Patent No.: US 9,617,937 B2
(45) Date of Patent: Apr. 11, 2017

(54) ENGINE CONTROL DEVICE FOR A WORK VEHICLE

(71) Applicant: CNH Industrial America LLC, New Holland, PA (US)

(72) Inventors: Massimo Baroni, Castellarano (IT); Eugenio Sereni, Modena (IT); Francesco Mancarella, Brindisi (IT)

(73) Assignee: CNH Industrial America LLC, New Holland, PA (US)

( * ) Notice: Subject to any disclaimer, the term of this patent is extended or adjusted under 35 U.S.C. 154(b) by 23 days.

(21) Appl. No.: 14/359,670

(22) PCT Filed: Nov. 14, 2012

(86) PCT No.: PCT/EP2012/072597
§ 371 (c)(1),
(2) Date: May 21, 2014

(87) PCT Pub. No.: WO2013/079324
PCT Pub. Date: Jun. 6, 2013

(65) Prior Publication Data

US 2014/0297158 A1 Oct. 2, 2014

(30) Foreign Application Priority Data

Nov. 28, 2011 (IT) ..... MO2011A0304

(51) Int. Cl.
*G06F 19/00* (2011.01)
*F02D 41/08* (2006.01)

(52) U.S. Cl.
CPC ..... *F02D 41/086* (2013.01); *F02D 41/08* (2013.01); *F02D 41/083* (2013.01); *F02D 2200/101* (2013.01); *F02N 2200/106* (2013.01)

(58) Field of Classification Search
CPC ..... F02D 41/08; F02D 41/083; F02D 41/086; F02D 41/16; F02D 2200/101; F02D 2200/106
(Continued)

(56) References Cited

U.S. PATENT DOCUMENTS 4,779,591 A * 10/1988 Tordenmalm ..... F02D 41/083 123/352
4,792,052 A * 12/1988 Okuda ..... B60K 28/04 123/198 D
(Continued)

FOREIGN PATENT DOCUMENTS

DE 10217095 11/2002
EP 1647686 4/2006
(Continued)

OTHER PUBLICATIONS

PCT International Search Report and Written Opinion for PCT/EP2012/072597 dated Mar. 7, 2013 (8 pages).
(Continued)

*Primary Examiner* — Stephen K Cronin
*Assistant Examiner* — David Hamaoui
(74) *Attorney, Agent, or Firm* — Rickard K. DeMille; Rebecca L. Henkel

(57) ABSTRACT

An engine control device for a vehicle is provided, which comprises a control unit configured to be connected to the engine of a vehicle and to control the switching of the engine from a first idle rotation speed to a second idle rotation speed in which the number of engine revolutions is lower compared to the number of revolutions of the first idle speed. The control device also includes a first sensor, configured to be connected to the engine and to instantaneously sense and transmit to the control unit the number of revolutions completed by the engine in the unit of time. The control
(Continued)

device further includes a second sensor for detecting the presence of an operator at the vehicle controls, and the second sensor is configured to transmit to the control unit a signal indicating the presence of an operator at the vehicle controls. The control unit is configured to actuate a decrease in the engine rotation speed from the first idle speed toward the second idle speed if the signal transmitted by the second sensor indicates the operator's absence and the signal transmitted by the first sensor indicates that the engine is running at the first idle speed.

13 Claims, 3 Drawing Sheets

(58) Field of Classification Search
USPC ..... 701/50, 102–104; 180/272
See application file for complete search history.

(56) References Cited

U.S. PATENT DOCUMENTS

| | | | | |
|---|---|---|---|---|
| 5,215,056 | A * | 6/1993 | Harada | B60K 17/28 123/198 D |
| 6,390,862 | B1 * | 5/2002 | Eichinger | B63H 11/08 440/1 |
| 6,694,240 | B1 * | 2/2004 | Swick | E02F 9/166 701/50 |
| 6,879,261 | B2 * | 4/2005 | Nishino | B60K 28/04 340/665 |
| 7,269,490 | B2 * | 9/2007 | Matsuda | E02F 9/26 340/438 |
| 7,497,195 | B2 * | 3/2009 | Umezu | E02F 9/2246 123/179.2 |
| 8,257,227 | B2 * | 9/2012 | Brand | A01G 23/06 477/172 |
| 9,032,718 | B2 * | 5/2015 | Noma | B66F 9/07595 60/295 |
| 2003/0217549 | A1 * | 11/2003 | Watanabe | F01N 3/0231 60/285 |
| 2005/0149244 | A1 | 7/2005 | Matsuda | |
| 2010/0170227 | A1 * | 7/2010 | Tsukada | E02F 9/00 60/286 |

FOREIGN PATENT DOCUMENTS

| | | | | |
|---|---|---|---|---|
| JP | 59231155 | | 12/1984 | |
| JP | 60206944 | | 12/1985 | |
| JP | WO 2011002055 | A1 * | 1/2011 | B66F 9/07595 |
| WO | 87/05966 | | 10/1987 | |
| WO | 2009/018352 | | 2/2009 | |

OTHER PUBLICATIONS

Search Report for Italian Application No. IT MO20110304 issued Jun. 25, 2012 (6 pages).

* cited by examiner

ENGINE CONTROL DEVICE FOR A WORK VEHICLE

CROSS REFERENCE TO RELATED APPLICATIONS

This application is the US National Stage filing of International Application Serial No. PCT/EP2012/072597, entitled "ENGINE CONTROL DEVICE FOR A WORK VEHICLE" filed Nov. 14, 2012, which claims priority to Italian Application Serial No. MO2011 A000304, filed Nov. 28, 2011, each of which is incorporated by reference herein in its entirety for all purposes.

FIELD OF THE INVENTION

The present invention relates to an engine control device for a work vehicle.

BACKGROUND OF THE INVENTION

Work vehicles, such as farm tractors and earthmoving machines, are frequently left in standby conditions with the engine idling. Such a situation occurs, for example, during work breaks, during the replacement or application of tools and during operations of hitching or unhitching trailers or sledges. In locations affected by very harsh climates, the vehicles are left idling overnight to avoid the risk of the oil and fuel becoming excessively cold.

Although the engine rotation speed under idling conditions is around 800-850 rpm, the fuel consumption and wear on mechanical parts are not, however, negligible. Thus engine control systems have recently been developed which, upon the occurrence of several operating conditions, further decrease the engine rotation speed to a second idle state, as low as 600-650 rpm.

The control systems presently available substantially work in this manner: each time the engine is left idling, a control unit runs a check on a series of operating parameters of the vehicle, e.g. activation of the parking brake, the absence of any commands on the operator's part, a zero forward travel speed, high voltage at the battery and high pressure at the oil pump. If one or more of the parameters listed above are satisfied, after a certain interval of time the control device lowers the engine rotation speed to the second idle state.

The control systems presently available thus carry out a check on a series of operating parameters of the vehicle before causing the engine to switch from idle to the second idle state. The operating parameters checked, however, offer a substantially indirect view of the vehicle's actual operating status. It is not always certain, in fact, that when the operating parameters remain in a certain state for a certain interval of time, this implies an actual possibility of switching to the second idle state of the engine. A typical case is represented by the moments in which the operator aboard the vehicle is engaged in technical conversations or in studying location plans or drawings and does not operate any controls on the vehicle. In such cases, it is necessary that at least the lighting and air conditioning devices remain on, and thus that the engine remain at idle without switching to the second idle state.

A further drawback of the control systems presently available is represented by the check, among the operating parameters checked by the control unit, on the elapsing of a given interval of time, measured by means of a timer. Essentially, before causing the engine to switch to the second idle state, the control unit checks that the operating conditions for switching to the second idle state are met up to the elapsing of a given interval of time. In many cases, that given interval of time is not necessary and substantially results in the engine remaining at idle pointlessly. Moreover, in many control systems the timer must be activated and set by the operator, with the risk that the operator will forget to activate it or set it on an incorrect interval of time.

The object of the present invention is to offer an engine control device which allows the drawbacks of the presently available control devices to be overcome.

SUMMARY OF THE INVENTION

One advantage of the control device according to the present invention is that it enables the engine to be switched from idle speed to the lower idle speed in a very effective manner.

Another advantage of the control device according to the present invention is that it considerably limits the unnecessary time the engine remains at idle.

BRIEF DESCRIPTION OF THE DRAWINGS

Further characteristics and advantages of the present invention will become better apparent from the detailed description that follows of an embodiment of the invention, illustrated by way of non-restrictive example in the appended figures, in which.

DETAILED DESCRIPTION OF THE INVENTION

The control device according to the present invention comprises a control unit 2 configured to be connected to the engine E of a vehicle. Besides having other functions, the control unit is configured to actuate the switching of the engine from a first idle rotation speed to a second idle rotation speed, in which the number of engine revolutions is lower compared to the number of revolutions of the first idle speed.

The device further comprises an engine rotation speed sensor 3, configured to be connected to the engine and to instantaneously sense the number of revolutions completed by the engine itself in the unit of time.

The control device additionally comprises a sensor 4 for detecting the presence of an operator at the controls of the vehicle. Said sensor is configured to transmit to the control unit a signal indicating the presence of an operator at the controls of the vehicle.

Preferably, the sensor for detecting the presence of an operator at the controls of the vehicle consists of a microswitch associated with the operator's seat. In particular, the microswitch can be interposed between the seat itself and a support structure for the seat so that the operator's weight upon the seat will bring about a compression or in any case an activation of the microswitch itself. Alternatively, the microswitch could be replaced by a pressure sensor, likewise associated with the seat, or by a motion sensor suitable for detecting the presence of movements inside the operator cab or in proximity to the vehicle controls.

In a first embodiment of the control device, if the signal of the presence sensor indicates the operator's absence and the engine is running at the first idle speed, the control unit will actuate a decrease in the engine rotation speed, from the first idle speed toward the second idle speed. If the signal of the presence sensor indicates the presence of an operator at the controls of the vehicle, the control unit will prevent the engine from switching from the first to the second idle speed. If the decrease in rotation speed has already begun, for example because the operator has got off the vehicle, the control unit will stop the decrease and bring the rotation speed back up to the first idle speed as soon as it receives a signal of the operator's presence. If the presence sensor is in the form of a microswitch associated with the seat of the vehicle, this will occur as soon as the operator sits down on the seat again.

Figure 1:
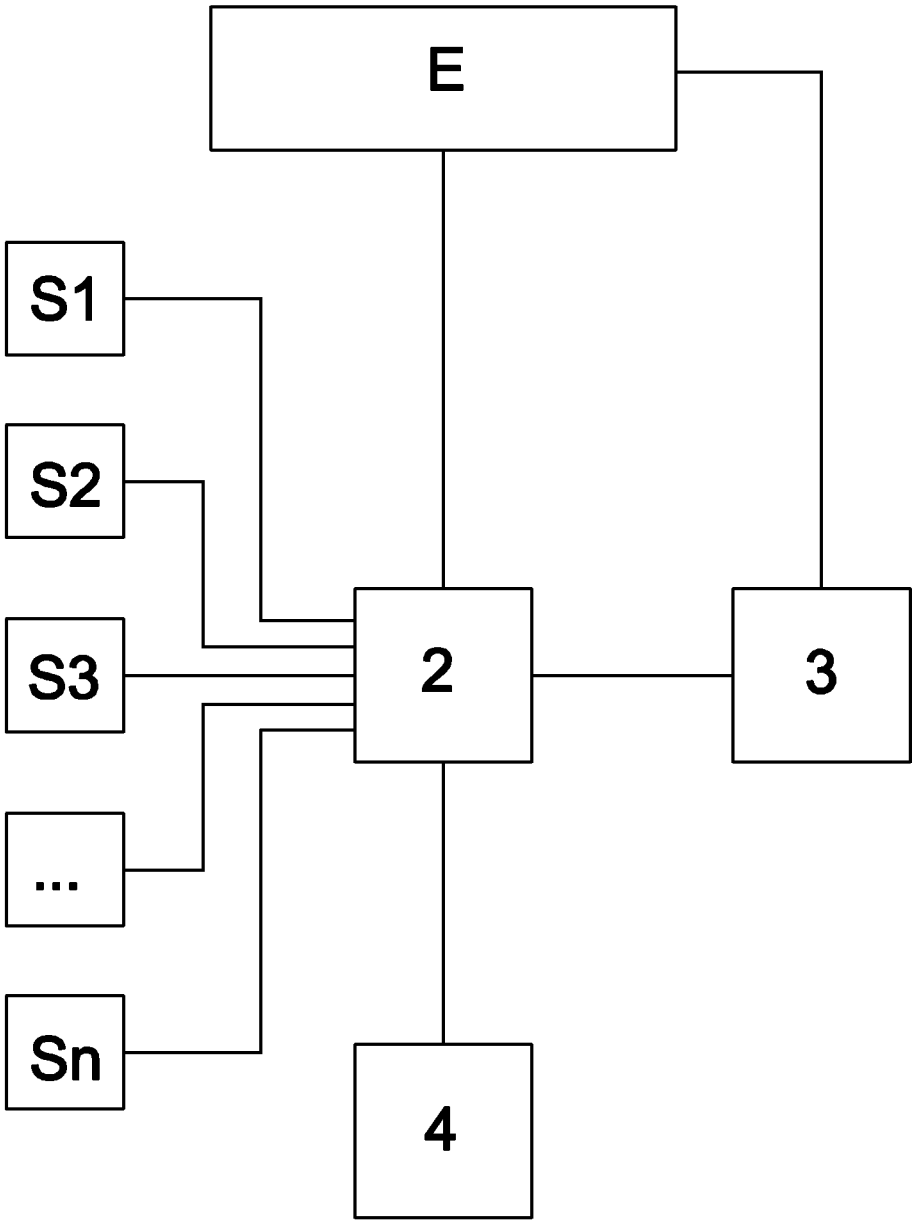
FIG. 1 shows a schematic diagram of a control device according to the present invention.
Figure 2:
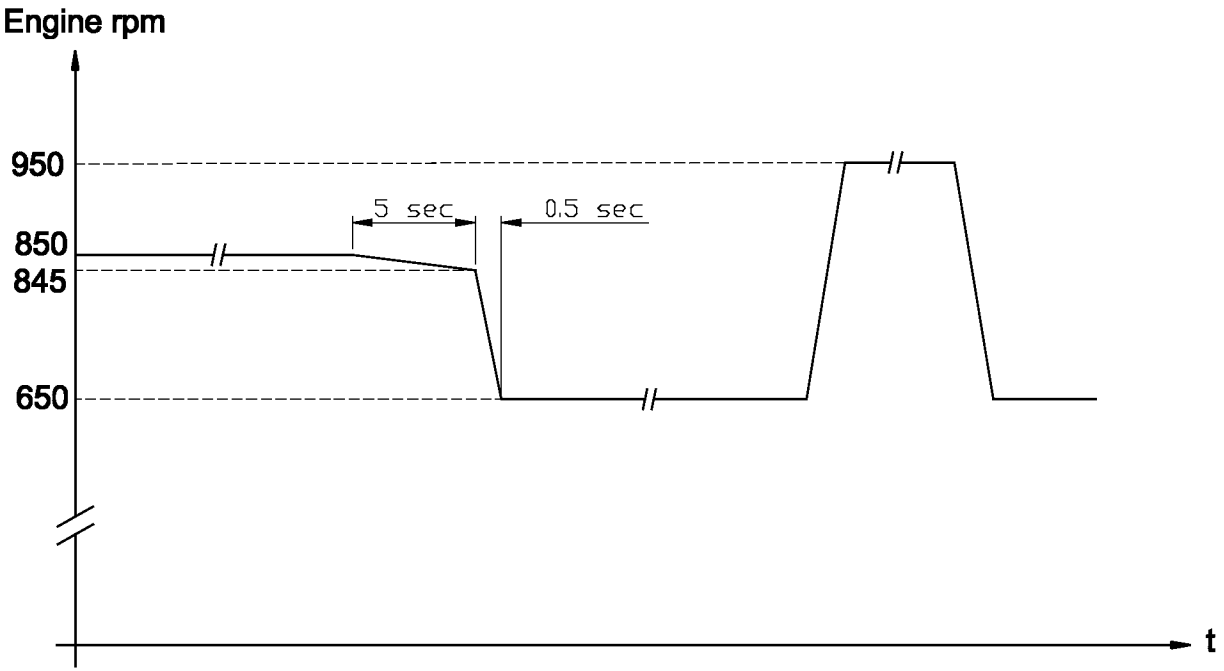
FIG. 2 discloses a schematic graphic time-engine rpm of the engine slowing controlled by the control device.
Figure 3:
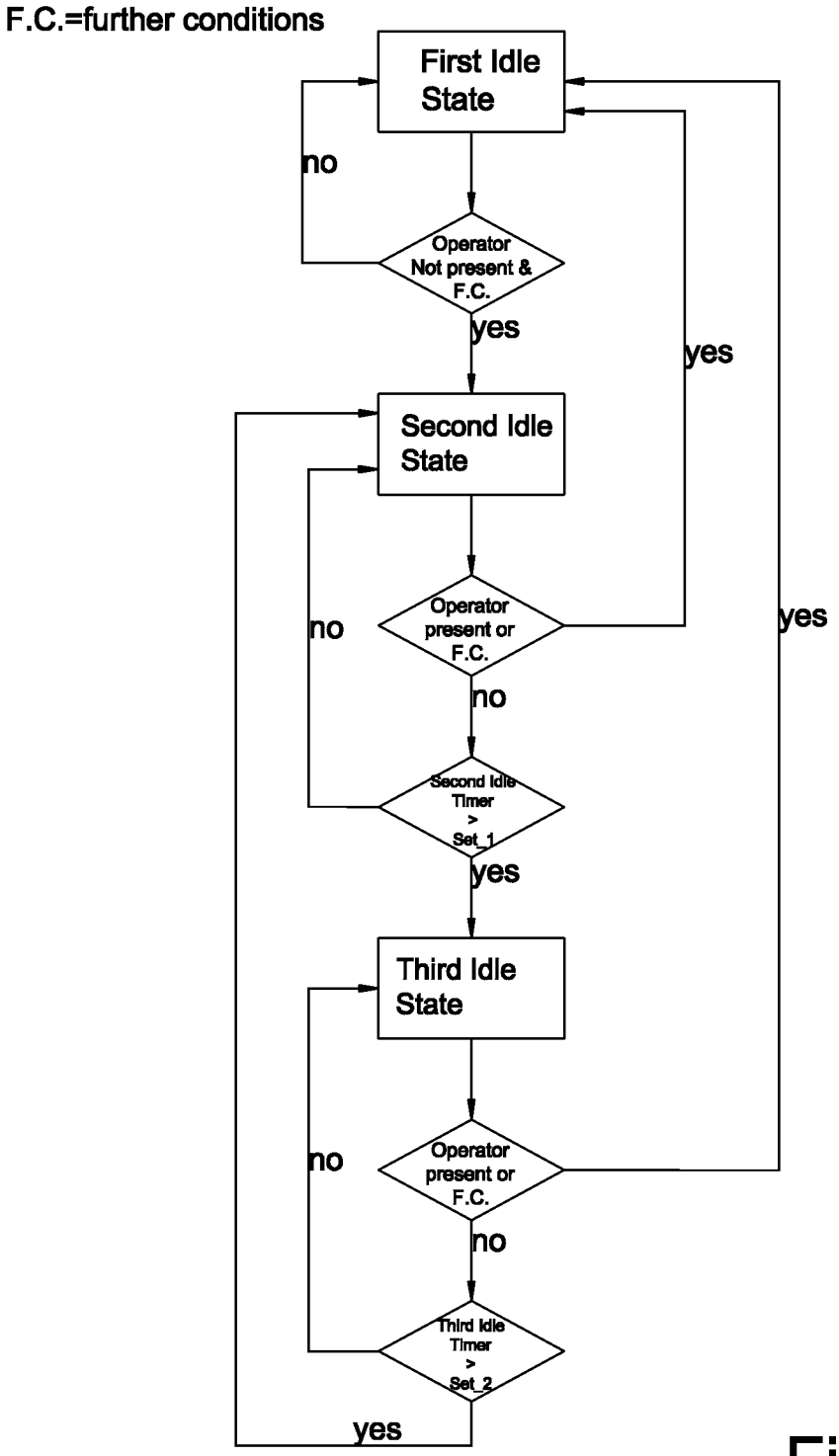
FIG. 3 discloses a flow chart which summarizes the working cycle of the control device.

Preferably, the control exercised by the control unit on the engine is instantaneous, i.e. as soon as the presence sensor signals to the control unit that the operator is absent from the controls of the vehicle, the control unit will immediately actuate a lowering of the engine rotation speed from the first toward the second idle speed, without waiting for any interval of time to elapse. The lowering of the engine rotation speed preferably takes place according to a preset time profile. Said time profile, for example, can provide for a slow initial decrease, of about 1 rpm/sec for the first 5 seconds, which decrease the engine speed from 850 rpm to 845 rpm, and a subsequent more rapid decrease, i.e. from 845 to 650 rpm in 0.5 seconds (FIG. 2). A time profile of this type would have the advantage of dampening the effect of any moves of the operator which have an influence on the presence sensor, but do not mean abandonment of the vehicle, since the reduction in rotation speed is substantially imperceptible.

In a second embodiment, the control device comprises additional sensors, connected to the control unit, which are configured to transmit to the control unit further signals indicating various operating parameters of the vehicle. Solely by way of example, different sensors can be configured to detect the following operating parameters of the vehicle:

- status of the transmission, in particular identification of the idle position and of clutch released;
- position of the accelerator, be it hand or foot operated, in particular the position of non-actuation of the accelerator;
- torque delivered by the engine lower than a given threshold;
- temperature of the cooling liquid falling within a given range of values;
- actuation status of the power take-off, in particular a status of non-actuation, with respect to both the main on board commands and remote commands, for example a fender switch if present; the actuation status of the power take off is preferably checked by checking the release of the power take-off clutch;
- position of the remote operating controls of the vehicle and/or of any tools associated with the vehicle, in particular non-actuation of the remote controls;
- battery voltage higher than a given value;
- transmission oil temperature higher than a given value;
- engine oil temperature higher than a given value;
- actuation status of the hydraulic hitch, in particular non-actuation of the hydraulic hitch.

The above-listed operating parameters are detected by means of sensors directly connected to the control unit, like for example the temperature of the cooling liquid, the temperature of the transmission oil, the temperature of the engine oil and the battery voltage. The vehicle may be provided with other consumers and/or hydraulic remotes the operation parameters of which are not detected by means of sensors directly connected to the control unit, but which are in any case detected through the torque sensor. An example of this kind of remote or consumer is a manual A/C circuit which is not connected to the control unit but, when it is in function, requires an increase of torque by the engine. When the torque delivered by the engine increases over the given threshold, the engine does not slow down to the second idle speed or, if in the second idle speed, the engine speed up to the first idle speed. Other consumers such as the engine cooling fan, the compressor for recharging the accumulator of the pneumatic braking circuit or other hydraulic loads may be detected through the torque sensor.

The above-listed operating parameters, or one or more of them, are preferably considered in conditions of "and" relative to the operator's presence aboard the vehicle. In particular, the control unit will actuate a lowering of the engine rotation speed only if the engine is running at the first idle speed and if it receives a signal of the operator's absence from the presence sensor and a positive signal from the sensors serving to determine the vehicle operating parameters. Supposing, for example, that one chooses a control which takes into account all of the above-listed operating parameters, the control unit of the device will actuate a reduction in the engine rotation speed only if the engine is running at the first idle speed and the presence sensor signals the operator's absence aboard AND the transmission is idling with the clutch released AND the accelerator is in a position of non-actuation AND the torque delivered by the engine is lower than a given threshold AND the temperature of the cooling liquid falls within a given range of values AND the power take-off is in a non-operational status AND the remote operating controls of the vehicle and/or of any tools associated with vehicle are in a position of non-actuation AND the battery voltage is higher than a given value AND the transmission oil temperature is higher than a given value AND the engine oil temperature is higher than a given value AND the hydraulic hitch is not activated.

There are obviously possible solutions where not all the above-listed operating parameters are monitored by the control unit.

In case the decrease of the engine speed has begun and one or more of the conditions:

engine at first idle speed;

operator not present;

one or more of the above further conditions;

are no more satisfied, the engine speed is increased back up to the first idle speed.

For new vehicles provided with diesel particle filter (DPF) and/or selective catalytic reduction (SCR), the control unit is configured also to determine an increase of the engine speed after a determined time interval in which the engine runs at the second idle speed, in order to avoid the excessive accumulation of polluting particles. The increase of the engine speed can lead to the first idle speed or to a third idle speed higher than the first idle speed, for example 950 rpm. After a determined time interval during which the engine runs at the third idle speed, the engine is slowed down to the second idle state.

Preferably, the control unit is configured to monitor the failure of a signal from the sensors present and, in the event that one or more of such signals is absent, to prevent switching to the second idle rotation speed. If, for example, the control unit does not detect any signal from the operator presence sensor, it will not allow the rotation speed to fall below the first idle speed. This check can obviously be extended to one or more of the other sensors present.

A further object of the present invention is a method for controlling the engine of a vehicle, comprising the following steps:

- checking by means of a first sensor (3) if an engine (E) of the vehicle is running at first idle speed;
- checking by means of a second sensor (4) if an operator is present at the controls of the vehicle;
- if the engine (E) is running at said first idle speed and if an operator is not present at the controls of the vehicle, decreasing the engine speed from the first idle speed to a second idle speed by means of a control unit (2) which receives signals sent by said first sensor (3) and second sensor (4).

If the step of decreasing the engine speed from the first idle speed to the second idle speed has begun and if one of the conditions of engine running at first idle speed and operator not present at the controls of the vehicle are no more satisfied, the engine speed is increased back up to the first idle speed.

The step of decreasing the engine speed from the first idle speed to the second idle speed is performed without delay upon both conditions of engine running at first idle speed and operator not present at the controls of the vehicle are satisfied.

Preferably, the step of decreasing the engine speed form the first idle speed to the second idle speed is performed according to a preset time profile which provides for a slower initial decrease followed by a subsequent more rapid decrease.

More preferably, the step of decreasing the engine speed form the first idle speed to the second idle speed is performed according to a preset time profile which provides for a decrease of 1 rpm/sec for the first 5 seconds followed by a decrease from 845 to 650 rpm in 0.5 seconds.

In a preferred embodiment of the method, the step of decreasing the engine speed from the first idle speed to the second idle speed is performed if one or more of the following further conditions, each one checked by means of a sensor, are satisfied:

- traction clutch released;
- position of non-actuation of the accelerator;
- torque delivered by the engine lower than a given threshold;
- temperature of the cooling liquid falling within a given range of values;
- status of non-actuation of the power take-off of the vehicle, preferably checking the release of the power take-off clutch;
- non-actuation position of the remote operating controls of the vehicle and/or of the tools associated with the vehicle;
- battery voltage higher than a given value;
- transmission oil temperature higher than a given value;
- engine oil temperature higher than a given value;
- non-actuation of the hydraulic hitch.

If one or more of the conditions engine running at first idle speed, operator not present or the above further conditions are no more satisfied, the step of decreasing the engine rotation speed from the first to the second idle speed does not start or, if has already started, the engine speed is increased back up to the first idle speed.

Advantageously, for safety reasons, if one or more of the conditions:

- engine at low idle speed;
- operator not present at the commands of the vehicle;
- traction clutch released;
- position of non-actuation of the accelerator;
- torque delivered by the engine lower than a given threshold;
- temperature of the cooling liquid falling within a given range of values;
- status of non-actuation of the power take-off of the vehicle, preferably checking the release of the power take-off clutch;
- non-actuation position of the remote operating controls of the vehicle and/or of the tools associated with the vehicle;
- battery voltage higher than a given value;
- transmission oil temperature higher than a given value;
- engine oil temperature higher than a given value;
- non-actuation of the hydraulic hitch;

cannot be detected for a failure, the step of decreasing the engine rotation speed from the first to the second idle speed does not start or, if has already started, the engine speed is increased back up to the first idle speed.

For new vehicles provided with diesel particle filter (DPF) and/or selective catalytic reduction (SCR), the method comprises a further step of increasing the engine speed after a determined time interval in which the engine runs at the second idle speed. Preferably the engine speed is increased to a third idle speed, higher than the first idle speed. The aim of this further step is to avoid the excessive accumulation of polluting particles which may occur when the engine runs at the second idle speed for a long time.

The present invention offers important advantages.

Checking for the presence of an operator at the controls of the vehicle is extremely advantageous. It is in fact an essential condition, from a practical standpoint, for establishing whether the engine rotation speed can be switched from the first to the second idle speed. Checking for the presence of an operator at the controls serves to avoid undesirable reductions in the rotation speed, for example in cases where the operator is present and is not acting on the vehicle controls simply because he is engaged in other activities, such as communicating with other operators or consulting drawings or maps. The immediate action of the control unit, which is not delayed by the elapsing of any preset time interval, also serves to limit the unnecessary periods in which the engine remains at the first idle speed, with the advantage of reducing fuel consumption and wear on the mechanical parts of the engine.

The invention claimed is:

1. An engine control device for a vehicle, comprising:

- a control unit configured to be connected to the engine of a vehicle and to actuate the switching of the engine from a first idle rotation speed to a second idle rotation speed in which the number of engine revolutions is lower compared to the number of revolutions of the first idle speed;
- a first sensor of the engine rotation speed, configured to be connected to the engine and to instantaneously sense and transmit to said control unit the number of revolutions completed by the engine in the unit of time;
- a second sensor for detecting the presence of an operator at the controls of the vehicle, which second sensor is configured to transmit to the control unit a signal indicating the presence of an operator at the controls of the vehicle;

wherein the control unit is configured to actuate a decrease in the engine rotation speed from the first idle speed toward the second idle speed if the signal transmitted by the second sensor indicates the operator's absence and the signal transmitted by the first sensor indicates that the engine is running at the first idle speed;

one or more additional sensors connected to the control unit, which are configured to transmit to the control unit additional signals indicating one or more additional operating parameters of the vehicle among:

traction clutch released;

position of non-actuation of the accelerator;

torque delivered by the engine lower than a given threshold;

temperature of the cooling liquid falling within a given range of values;

status of non-actuation of the power take-off of the vehicle;

non-actuation position of the remote operating controls of the vehicle and/or of the tools associated with the vehicle;

battery voltage higher than a given value;

transmission oil temperature higher than a given value;

engine oil temperature higher than a given value;

non-actuation of the hydraulic hitch;

wherein the control unit actuates a decrease in the engine rotation speed from the first idle speed toward the second idle speed only if the signal transmitted by the first sensor indicates that the engine is running at the first idle speed, if the signal transmitted by the second sensor indicates the operator's absence, and if the signals transmitted by one or more of said additional sensors are positive;

wherein the control unit is configured to actuate a decrease in the engine rotation speed from the first to the second idle speed instantaneously upon receiving:

a signal from the second sensor which indicates the operator's absence;

a signal from the first sensor which indicates that the engine is running at the first idle speed; and a positive signal from one or more of the further sensors; and wherein the control unit is configured to actuate the decrease in the engine rotation speed from the first idle speed to the second idle speed by decreasing the engine speed at a first rate for a first time period and decreasing the engine speed at a second rate, greater than the first rate, for a second time period.

2. The engine control device according to claim 1, wherein the control unit is configured to prevent the decrease in the engine rotation speed from the first to the second idle speed and, if the decrease has already begun, to stop the decrease and bring the rotation speed back up to the first idle speed if at least one of the signals transmitted by one or more of the first sensor, second sensor, further sensors is not positive.

3. The engine control device according to claim 1, wherein the control unit is configured to actuate an increase of the engine rotation speed after a determined time interval during which the engine runs at the second idle speed.

4. The engine control device according claim 3, wherein the control unit is configured to actuate an increase of the engine rotation speed from the second idle speed to a third idle speed, higher than the first idle speed, after the determined time interval during which the engine runs at the second idle speed.

5. A method for controlling the engine of a vehicle, the following steps:

checking by means of a first sensor if an engine of the vehicle is running at first idle speed;

checking by means of a second sensor if an operator is present at the controls of the vehicle;

determining if the engine is running at said first idle speed and if an operator is not present at the controls of the vehicle, decreasing the engine speed from the first idle speed to a second idle speed by means of a control unit which receives signals sent by said first sensor and second sensor, wherein the step of decreasing the engine speed from the first idle speed to the second idle speed is performed if one or more of the following further conditions, each one checked by means of a sensor, are satisfied:

traction clutch released;

position of non-actuation of the accelerator;

torque delivered by the engine lower than a given threshold;

temperature of the cooling liquid falling within a given range of values;

status of non-actuation of the power take-off of the vehicle;

non-actuation position of the remote operating controls of the vehicle and/or of the tools associated with the vehicle;

battery voltage higher than a given value;

transmission oil temperature higher than a given value;

engine oil temperature higher than a given value;

non actuation of the hydraulic hitch;

wherein the step of decreasing the engine speed from the first idle speed to the second idle speed is performed without delay when all of the following conditions are satisfied:

engine running at first idle speed;

operator not present at the controls of the vehicle;

a positive signal form one or more of the further sensors; and wherein the step of decreasing the engine speed from the first idle speed to the second idle speed is performed by decreasing the engine speed at a first rate for a first time period and decreasing the engine speed at a second rate, greater than the first rate, for a second time period.

6. The method according to claim 5 wherein, if the step of decreasing the engine speed from the first idle speed to the second idle speed has begun and if one of the conditions of engine running at first idle speed, operator not present at the controls of the vehicle or a signal from one of said further conditions are no more satisfied, the engine speed is increased back up to the first idle speed.

7. The method according to claim 5, wherein if one or more of the conditions:

engine at low idle speed;

operator not present at the commands of the vehicle;

traction clutch released;

position of non-actuation of the accelerator;

torque delivered by the engine lower than a given threshold;

temperature of the cooling liquid falling within a given range of values;

status of non-actuation of the power take-off of the vehicle;

non-actuation position of the remote operating controls of the vehicle and/or of the tools associated with the vehicle;

battery voltage higher than a given value;

transmission oil temperature higher than a given value;

engine oil temperature higher than a given value;

non-actuation of the hydraulic hitch;

cannot be detected for a failure, the step of decreasing the engine rotation speed from the first to the second idle speed does not start or, if it has already started, the engine speed is increased back up to the first idle speed.

8. The method according to claim 7, comprising a further step of increasing the engine speed after a determined time interval in which the engine runs at the second idle speed.

9. The method according to claim 8, comprising a further step of increasing the engine speed to a third idle speed, higher than the first idle speed, after a determined time interval in which the engine runs at the second idle speed.

10. The method according to claim 5, wherein the second time period is shorter than the first time period.

11. The method according to claim 5, wherein the first rate is about 1 rotation per min (RPM) per second.

12. The engine control device according claim 1, wherein the second time period is shorter than the first time period.

13. The engine control device according claim 1, wherein the first rate is about 1 rotation per min (RPM) per second.

* * * * *